United States Patent [19]

Hovstadius

[11] 4,383,639

[45] May 17, 1983

[54] ARRANGEMENT FOR REMOVING LIQUID FROM A ROTATING HOUSING

[75] Inventor: Gunnar Hovstadius, Sigtuna, Sweden

[73] Assignee: Alfa-Laval AB, Tumba, Sweden

[21] Appl. No.: 273,609

[22] Filed: Jun. 15, 1981

Related U.S. Application Data

[63] Continuation of Ser. No. 72,589, Sep. 5, 1979, abandoned.

[51] Int. Cl.[3] ..... B04B 1/00; B04B 3/00

[52] U.S. Cl. ..... 494/43; 494/85

[58] Field of Search ..... 233/27, 28, 34, 38, 233/40, 45, 46

[56] References Cited

U.S. PATENT DOCUMENTS

| | | | |
|---|---|---|---|
| 736,978 | 8/1903 | Keiper | 233/34 |
| 3,011,695 | 12/1961 | Boyland | 233/46 |
| 3,936,214 | 2/1976 | Zupanick | 233/27 |

FOREIGN PATENT DOCUMENTS 56431 7/1939 Denmark .

*Primary Examiner*—Philip R. Coe
*Assistant Examiner*—Timothy F. Simone
*Attorney, Agent, or Firm*—Cyrus S. Hapgood

[57] ABSTRACT

Liquid forming an annular body in a rotating housing is removed therefrom by a stationary paring device with an annular part adapted to extend substantially radially into said body and having a channel for draining liquid from the housing. Sunken into a surface of the annular part is an opening forming an entrance to the channel, and liquid flows in through said opening along a path located at a substantially constant radius from the rotation axis, the opening having a sloping bottom for guiding the liquid into the channel. In that portion of the annular part which is immersed in the liquid body, said channel extends in a plane substantially parallel with said surface of the annular part.

9 Claims, 3 Drawing Figures

ARRANGEMENT FOR REMOVING LIQUID FROM A ROTATING HOUSING

Figure 1:
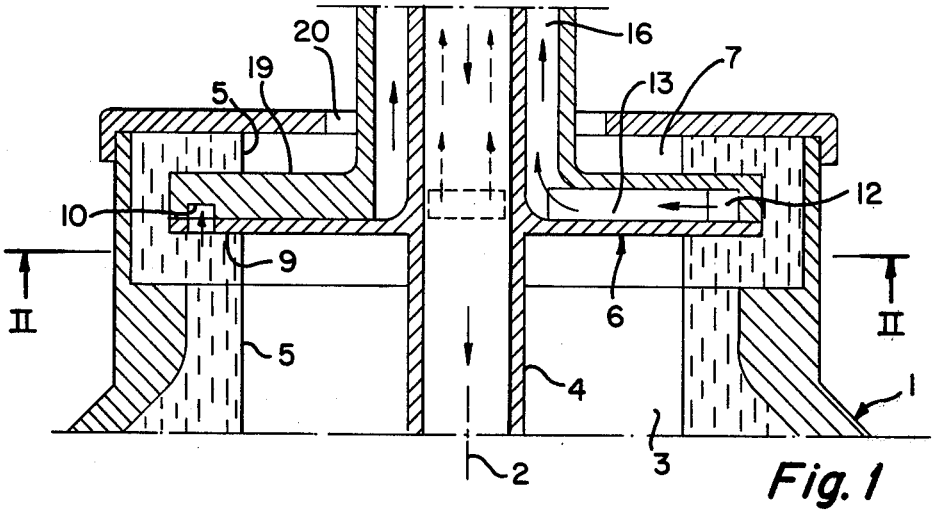

This application is a continuation of my copending application Ser. No. 72,589 filed Sept. 5, 1979, abandoned; and, as in the case of said copending application applicant claims priority based upon Swedish Application No. 7809465-3 filed Sept. 8, 1978.

This invention relates to an arrangement to remove liquid from a rotating housing, which liquid rotates with the housing, comprising a stationary paring means having an annular part which protrudes into the rotating liquid and extends around the rotation axis of the housing. Such part is provided with at least one opening which constitutes the entrance of a channel for draining liquid from the housing, the opening being arranged in a surface of the annular part which faces in substantially axial direction on to the liquid in the housing. The part of the channel which adjoins the opening is arranged so that the liquid flows in through the opening along a path located on a substantially constant radius from the rotation axis of the housing.

The above-noted arrangement is known through the Danish Pat. No. 56431, which shows a paring means in the form of a bowl, where openings for draining liquid are arranged in the rim of the bowl, which rim is directed substantially axially.

In the known arrangement, the liquid flows in the axial direction towards the openings and is caught by these without the liquid previously moving in a radial direction. A decreased flow loss will thus be obtained when the liquid enters the paring means. With paring means where the liquid must move radially on entering through the openings of the paring means (e.g., in a commonly occurring type of paring disc where the openings open partly radially at the outer periphery of the disc), the loss becomes substantially larger when the liquid flows in through the openings. This is due to the fact that the rotating liquid, when flowing radially towards the openings of the paring means, according to known flow laws, increases it velocity of rotation whereby the centrifugal force on the liquid increases and counteracts the flowing in of the liquid through the openings.

With the known arrangement, the channel parts which adjoin the openings of the paring means in the liquid have been given a substantially axial extension and the paring means has correspondingly been formed like a bowl.

Such a bowl-formed paring means has the drawback, however, that it presents a large surface in contact with the rotating liquid, whereby the friction losses become large when the liquid rotates around the paring means. Furthermore, the known paring means takes a large space in the axial direction.

The principal object of the invention is to maintain said axial inflow into the paring means but to substantially decrease its surface which is in contact with the liquid and to decrease its extension in the axial direction.

This object is obtained through the arrangement according to the invention, in which the annular part extends substantially radially into the rotating liquid, the opening is sunken in the surface, and a sloping bottom is arranged to guide the liquid in through the opening to the channel, which in at least the part of the annular part located in the liquid extends in a plane which is substantially parallel with the surface.

In this way, a paring means is obtained which has the advantages of said axial inflow, has a large flow capacity, gives a minimum of friction losses and takes a small space in the axial direction.

According to a further development of the invention, the sloping bottom extends arcuately, as seen in axial direction, preferably adjacent the periphery of the annular part. Thus, the leading in of the liquid through the opening on a constant radius from the rotation axis of the housing is further promoted.

According to a further development of the invention, the part of the channel which adjoins the opening continues through a bend to a radial channel part, guiding vanes being arranged in the bend. A path is thus obtained for leading the liquid radially inwards from the opening, which path offers a minimum of flow resistance against the liquid.

According to a further development of the invention, the edge which is formed between the opening and the adjoining surface of the annular part is rounded. Thus, different flows can be taken in through the opening without the liquid getting loose from the edge and thereby causing disturbances in the rotating liquid. Different flows means that the liquid will flow towards the edge at different angles of attack. A rounded edge allows (within certain limits) an altering of the angle of attack without the liquid getting loose from the edge.

According to a further development of the invention, which is intended for applications where one side of the annular part communicates directly with ambient atmosphere, the opening is arranged on the other side of the annular part. The free surface between the liquid and ambient atmosphere will thus rotate substantially undisturbed by the flow through the opening, which is located on the other side of the annular part. This insures that ambient atmosphere is not mixed into the liquid and sucked in through the opening of the paring means.

Figure 2:
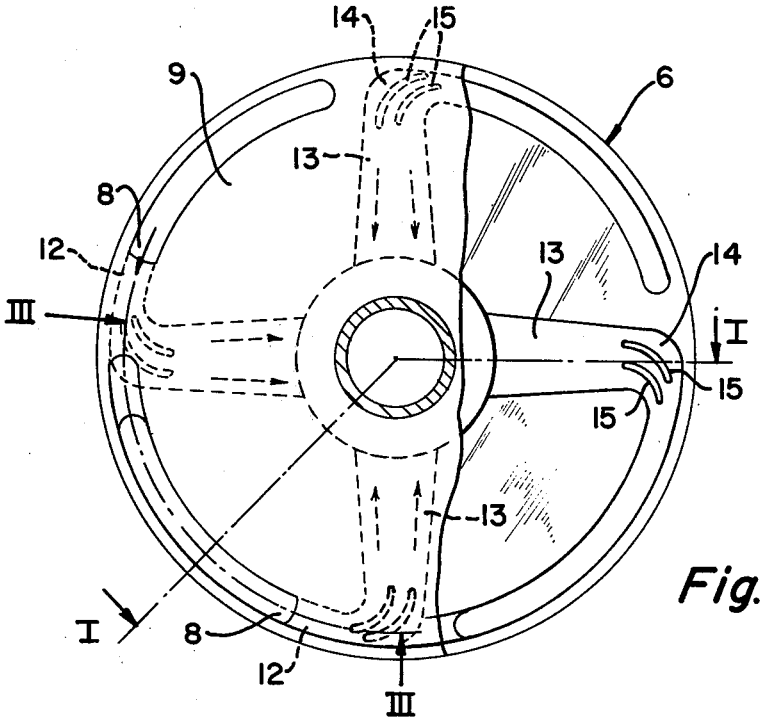
Figure 3:
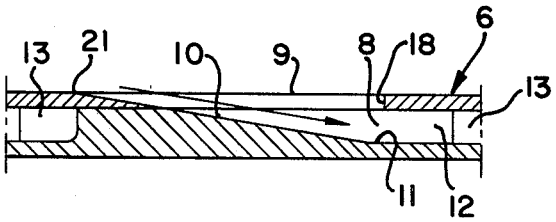

An example of an embodiment of the invention is described below in connection with the attached drawing, in which FIG. 1 is an inverted longitudinal sectional veiw on the line I—I in FIG. 2 showing a part of a rotating housing with a stationary paring means;

FIG. 2 is a view of the paring means on the line II—II in FIG. 1, a part of the paring means being broken away;

and,

FIG. 3 is a sectional view on the line III—III in FIG. 2.

In the drawing, a housing 1 rotates around an axis 2. The housing 1 encloses a chamber 3 to which liquid is continuously supplied through a tube 4. The liquid is caused to rotate with the housing so that a free surface 5 of the liquid is formed in the chamber 3.

The housing 1 can be constituted by the centrifuge rotor of a centrifugal separator, the chamber 3 constituting the separating chamber of the rotor.

After its passage through the chamber 3, the liquid is continuously removed from the housing through a stationary paring means in the form of a flat disc 6, which extends at right angles to the axis 2 and which is arranged in a chamber 7 at one end of the housing. The disc 6 has four openings 8 which are located in the liquid radially outside the surface 5 and which are formed in a planar surface 9 of the disc 6, which surface 9 faces in the axial direction toward the liquid in the housing 1.

The openings 8 are sunken in the surface 9. A sloping bottom or ramp 10 leads to each opening 8, which bottom, as seen in the axial direction of the disc, extends arcuately through the opening 8 and adjoins a farther wall 11 of a part 12 of a channel which adjoins the opening and through which liquid is discharged from the opening.

The bottom 10, which has a constant inclination along its whole length, is given such a slight inclination that the liquid will not get loose from it when flowing towards the opening 8. The edge 21 formed between the surface 9 and the bottom 10 is suitably rounded, so that the liquid here will not get loose from the disc 6 on its flowing towards the opening 8.

From the chamber 3, the liquid moves in a helical path towards the disc 6 and in through the openings 8 without having to move in a radial direction prior to passing in through the respective openings 8. From each opening 8, the liquid is led by the channel part 12 to a radially arranged channel part 13 via a bend 14. In the bend 14, guiding vanes 15 are arranged over the whole height of the bend. The object of the guiding vanes 15 is to decrease the flow losses of the liquid flow through the bend. From the channel part 13, the liquid is led out of the disc 6 through an axial channel 16. The channel part 12 and the channel part 13 are located in a common plane, which is parallel with the surface 9.

The edge 18 formed between the opening 8 and the surface 9 is rounded, whereby different flows can be taken in through the opening 8 without the liquid getting loose from the edge 8 and thereby causing disturbances in the rotating liquid.

The disc communicates on its upper side 19 directly with ambient atmosphere through an opening 20. The liquid surface 5 at the upper side of the disc rotates substantially undisturbed by the flow through the openings 8.

It will be noted that the channel 12–13 extends beneath surface 9 of the paring disc 6 at a small and constant distance from surface 9.

In FIG. 1, the solid arrows within tube 4 indicate the flow direction of the liquid supplied to chamber 3 through this tube; and the solid arrows within channel 16, as well as the arrows with broken lines within tube 4, indicate the flow direction of the liquid being discharged from disc 6 through channel 16.

It will be apparent that the disc's lower surface 9 and upper side 19 constitute opposite exterior surfaces of the disc. Also, the opening 8 is adjoined by the portion 12 of the discharge channel 12, 13, 16 in the paring device.

We claim:

1. In combination with a rotary housing having a rotation axis and adapted to receive a liquid which, during rotation of the housing, forms an annular liquid body rotating around said axis in one direction, means for removing liquid from said body comprising a stationary paring device having a disc adapted to extend substantially radially into the rotating liquid body, the disc being provided with an outer peripheral edge extending around said axis, said disc having a channel for draining liquid from the housing and also having opposite exterior surfaces lying in respective planes extending substantially radially from said axis to said outer edge, one of said surfaces facing toward said liquid body, said disc also having an opening which is sunken in said one surface and forms an entrance of said channel, the portion of said channel adjoining said opening being formed so that liquid flows in through said opening along a path located at a substantially constant radius from said axis, said disc having a ramp sunken in said one surface and extending therefrom toward the opening in said one direction of rotation of the liquid body, said ramp forming a gently sloping bottom for guiding the liquid into the channel by way of said opening, said sloping bottom, opening and the portion of the channel adjoining said opening being formed so that liquid enters the opening along said path in a plane substantially perpendicular to said rotation axis, said channel extending from the opening through the disc beneath said one surface at a small and constant distance from said one surface, said outer peripheral edge being substantially confined between said planes.

2. The combination of claim 1, in which said sloping bottom, as viewed in the direction of said axis, extends in an arc partly around said axis.

3. The combination of claim 2, in which said sloping bottom is located adjacent the outer periphery of said disc.

4. The combination of claim 1, in which there is an edge formed between said opening and the adjoining part of said surface, said edge being rounded.

5. The combination of claim 1, in which one side of said disc communicates directly through said housing with ambient atmosphere, said opening being located in the opposite side of the disc.

6. The combination of claim 1, in which said outer peripheral edge is completely confined between said planes.

7. The combination of claim 1, in which said planes are perpendicular to said axis.

8. The combination of claim 1, in which said channel includes a radial portion, the part of the channel which adjoins said opening continuing through a bend to said radial portion, the combination comprising also guiding vanes located in said bend of the channel.

9. The combination of claim 8, in which said sloping bottom, as viewed in the direction of said axis, extends in an arc partly around said axis and is located adjacent the outer periphery of said disc, said disc having a rounded edge formed between said opening and the adjoining part of said one surface, the other of said opposite exterior surfaces communicating directly through said housing with ambient atmosphere.

* * * * *